United States Patent [19]

Jeschke et al.

[11] Patent Number: 4,846,061

[45] Date of Patent: Jul. 11, 1989

[54] GRIPPER DEVICE FOR A PRINTING MACHINE

[75] Inventors: Willi Jeschke; Dieter Bergmeier, both of Heidelberg, Fed. Rep. of Germany

[73] Assignee: Heidelberger Druckmaschinen AG, Heidelberg, Fed. Rep. of Germany

[21] Appl. No.: 138,508

[22] Filed: Dec. 24, 1987

[30] Foreign Application Priority Data

Dec. 24, 1986 [DE] Fed. Rep. of Germany ..... 3644484

[51] Int. Cl.[4] ..... B41F 1/30

[52] U.S. Cl. ..... 101/408; 101/409; 271/206

[58] Field of Search ..... 101/408, 409; 271/277, 271/268, 204, 206, 205; 269/265, 274, 275, 286

[56] References Cited

U.S. PATENT DOCUMENTS

| | | | |
|---|---|---|---|
| 2,418,065 | 5/1947 | Bobst | 101/408 |
| 2,906,204 | 9/1959 | Luehrs | 101/409 |
| 3,536,321 | 10/1970 | Straube | 101/409 |
| 4,058,307 | 11/1977 | Bubley et al. | 101/408 |
| 4,155,305 | 5/1979 | Heissler et al. | 101/408 |
| 4,203,363 | 5/1980 | Walter et al. | 101/409 |
| 4,427,193 | 1/1984 | Kahlert et al. | 101/408 |
| 4,530,495 | 7/1985 | Zimmermann et al. | 271/204 |
| 4,579,331 | 4/1986 | Nestler | 271/268 |
| 4,718,342 | 1/1988 | Raab et al. | 101/409 |
| 4,718,343 | 1/1988 | Gensheimer | 101/409 |

*Primary Examiner*—E. H. Eickholt

*Attorney, Agent, or Firm*—Herbert L. Lerner; Laurence A. Greenberg

[57] ABSTRACT

A gripper device for a printing machine for handling sheet-shaped material with a gripper shaft swivellable about its longitudinal axis and a gripper finger firmly connected to the gripper shaft so that a gripper point thereof is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and a device for adjusting contact between the gripper point and the gripper support includes a resilient section forming a part of the gripper finger and connected to the gripper point, the resilient section having neutral fibers and formed as at least one resilient rod extending substantially in the direction of a plane determined by the longitudinal axis of the gripper shaft and by the gripper point.

20 Claims, 3 Drawing Sheets

GRIPPER DEVICE FOR A PRINTING MACHINE

SPECIFICATION

The invention relates to a gripper device for a printing machine and, more particularly, for handling sheet-shaped material, with a gripper shaft swivellable about the longitudinal axis thereof, and a gripper finger having a resilient section and firmly connected to the gripper shaft so that a gripper point thereof is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support.

Such a gripper device has become known heretofore from European Published Non-Prosecuted Application (EP-OS) 0 152 553 wherein a gripper finger of springy or resilient construction is disclosed as being screwed onto a bipartite clamping member which provides a connection with a gripper shaft which is secure against torsion. When closing this gripper device, the point initially comes into contact with a gripper support. To attain an adequate holding force in the region of a printed sheet engaged by the gripper point, the gripper shaft is turned a further amountin closing direction. The holding force results from the accompanying deflection of the gripper point out of its position opposite the clamping member in the opened condition of the gripper device. Due to the contact of the gripper point with the gripper support, the circular movement of the gripper point is interrupted and, with a progressive rotation of the gripper shaft in the closing direction, the gripper finger is held back, like a resilient connecting rod, in rotary direction of a crank gear or crank assembly, the connecting rod being firmly clamped to the crank gear or crank assembly and being guided in a cross-head with the result that the gripper point shifts with respect to the gripper support and, accordingly, exerts a disruptive influence upon the maintenance of register of a clamped printed sheet or sheet to be printed.

A gripper device heretofore known from European Patent 0 073 955 utilizes the analogies of a generic gripper device to a crank gear or crank assembly in order to reduce the shifting movement of the gripper point to the shortest path. For this purpose, it utilizes an angularly bent, resilient gripper finger of which a resilient end facing towards the gripper shaft, and the gripper point are disposed on a common straight line extending through the middle of the gripper shaft. Due to a Z-shaped construction of the gripper finger, the patentee seeks to achieve the following: that the straight sections thereof behave somewhat like the arms of a multilinkage lever articulatingly connected to the clamping location of the gripper finger at the gripper shaft, in the various linkages of which, restoring forces act upon the arms when changes in the angular position of the arms occur, the end of the gripper finger corresponding to the gripper point being frictionally in engagement with the gripper support under the holding force of the gripper finger.

The increase in the spacing between the gripper support and the clamped end of the gripper finger accompanying the rotation or turning of the gripper shaft over the aforementioned further amount to produce the aforementioned holding force should effect an automatic corresponding increase in the effective length of the gripper finger during the stroke of the gripper finger, in the European patent. Thereby, shifting of the gripper point on the gripper support is supposed to be prevented.

Actually, though, the desired effect is not achieved, however, with the means disclosed in the foregoing European patent. On the contrary, due to the Z-shaped construction of the gripper finger, the latter is to a great extent very soft in bending in the longitudinal direction determined by the middle of the gripper shaft and the gripper point. This results in that the gripper point shifts during closure of the gripper and when tensile forces of the paper occur, respectively. The heretofore known gripper of the European patent cannot avoid this shift without additional features.

A further attempt to solve the problem of preventing the aforementioned shifting movement of the gripper point on the gripper support has become known heretofore from the device disclosed in U.S. Pat. No. 2,906,204 which provides an intermediate member between a gripper finger connected to the gripper shaft secured against torsion, and a gripper part pivotable about the gripper shaft and subjected to the action of a closing spring, as has become known from U.S. Pat. No. 3,536,321.

In the device of U.S. Pat. No. 2,906,204, the aforementioned shifting movement is supposed to be avoided by a floatingly assembled gripper finger. The rear region of the latter surrounds substantially half of the periphery of the gripper shaft without actually engaging the latter. It is installed, respectively, exclusively in its regions connected directly to the semicircular part under spring bias against a lower half-shell connected with the gripper shaft secured against torsion. The region of the gripper finger installed under spring bias against the lower half-shell is, furthermore, held by means of a bore formed in the gripper finger and extending perpendicularly to the support surface of the gripper finger on the half shell and a threaded bolt aligned therewith for clamping the lower and upper half shells, so that the gripper fingers can tip with respect to the threaded bolts when it is lifted from the opposing support region.

Altogether, this heretofore known device represents a so-called hook gripper with which the additional turning of the gripper shaft over the stated extent or amount to attain an adequate holding force should be accomplished by the resilient bracing of the gripper finger. It is true as well, in this case, as for the Z-shaped construction, that the gripper is not sufficiently stiff in bending when loaded in the longitudinal direction thereof through the middle of the gripper shaft and through the gripper point. The material which is guided around the gripper shaft, moreover, permits a stroke of the gripper in longitudinal direction and causes shifting of the paper.

Furthermore, the floating bearing or support of the gripper finger cannot ensure a reproducible gripping and holding of a printed sheet at one and the same location, respectively. A play-free bearing of the gripper finger is an essential prerequisite for achieving a register-maintained printing.

A gripper finger having a resilient section formed of two-parallel-connected mutually-spaced resilient rods has become known heretofore from U.S. Pat. No. 3,536,321. In this patent, a spring package is fastened firmly on a loose first ring which is rotatable about the gripper shaft; the first ring being entrained in one rotary direction by an entrainer pin of a second ring connected with the gripper shaft so as to be secured against torsion, and in the other rotary direction is turned under the bias of a tension spring against a stop.

At the head end of the gripper finger, a guide rod is arranged which passes through the loose ring, the guide rod acting upon the head end in closing direction under the biasing action of a compression spring braced against this platform and pressed in the opposite direction by a second ring connected torsion-free with the gripper shaft.

In this regard, the device in its entirety is selected so that the resilient rods are substantially relaxed or untensioned when contacting the gripper support, and the holding free of the compression spring installed between the end of the guide rod and the platform is applied. The resilient rods thereby assume the function of a nearly parallel guidance of the gripper point in the end phase of the closing movement.

To adjust the contact of the gripper point with the gripper support, a foot adjustable along the guide rod is provided, against which the other end of the compression spring braced at one side against the aforementioned platform is pressed.

This gripper device is naturally subject to a given necessary play in the bearing of the gripper finger on the gripper shaft. By the running up or loosening of the loose ring from the entrainer, the forces of the mass moment of inertia vary in each rotary direction of the gripper shaft during the rotation or turning. Due to its cooperation with the respective springs activated thereby, undesired torsional oscillations of the entire gripper device occur, moreover.

It is accordingly an object of the invention to provide a gripper device of the aforedescribed general type wherein shifting of the gripper point on the gripper support is virtually nil with a gripper finger which is constructed as simply as possible.

With the foregoing and other objects in view there is provided, in accordance with the invention, a gripper device for a printing machine for handling sheet-shaped material with a gripper shaft swivellable about its longitudinal axis and a gripper finger firmly connected to the gripper shaft so that a gripper point thereof is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support, comprising a resilient section forming a part of the gripper finger and connected to the gripper point, the resilient section having neutral fibers and formed as at least one resilient rod extending substantially in the direction of a plane determined by the longitudinal axis of the gripper shaft and by the gripper point.

In accordance with a more specific construction of the invention, there is provided a gripper device, wherein the resilient section is formed as a single resilient rod extending substantially in the plane determined by the longitudinal axis of the gripper shaft and by the gripper point.

In accordance with an alternate construction of the invention, there is provided a gripper device, wherein the resilient section is formed of two mutually resilient rods spaced from one another, connected in parallel with one another and extending in planes parallel to the first-mentioned plane.

The invention offers the possibility, especially when using only one resilient rod, of producing a device with a relatively loss mass moment of inertia which is applicable advantageously to high-speed printing machines.

The embodiments of the invention can be readily assembled and disassembled. In this regard, the gripper shaft need not be removed from the machine.

The adjusting means, moreover, permit a precise individual setting of the contact of a gripper point with printed sheets clamped between it and the gripper support, so that manufacturing tolerances and, if desired, also differences in paper thickness can be compensated without difficulty.

In contrast with the floatingly mounted gripper finger known from the aforecited state of the art, a reproducible placement of the gripper point against a reproducible contact location with the printed sheet is assured, so that the latter is not subjected to any changes due to varying gripper contacts.

In addition, only a relatively small number of relatively simple and lightweight components are required, so that the precise function is achievable also in an economical manner.

The invention of the instant application is suitable especially for such an installation in a printing machine wherein the middle of the gripper shaft extends beyond the assumed extension of the sheet-shaped material clamped by the gripper device, past the leading edge of the sheet.

If necessary or desirable, one can dispense with any special shaping of the gripper finger for achieving a prestressing in the installation position.

In accordance with another construction of the invention, there is provided a gripper device for a printing machine for handling sheet-shaped material with a gripper shaft swivellable about its longitudinal axis and a gripper finger firmly connected to the gripper shaft so that the gripper point is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support, comprising a resilient section forming a part of the gripper finger and connected to the gripper point, the resilient section having neutral fibers and being formed as a single resilient rod extending substantially in a plane determined by the longitudinal axis of the gripper shaft and by the gripper point, the resilient section extending freely through the gripper shaft and being firmly clamped at the end thereof facing away from the gripper point to a rigid connection with the gripper shaft.

Such a gripper device can be used advantageously under confined spatial conditions. It permits the use of relatively long and, accordingly, softly bending gripper fingers with small spacings between the gripper shaft and the gripper cushion, so that no impermissible bending stresses occur.

In accordance with a furter construction of the invention, there is provided a gripper device for a printing machine for handling sheet-shaped material with a gripper shaft swivellable about its longitudinal axis and a gripper finger firmly connected to the gripper shaft so that the gripper point is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support, comprising a resilient section forming a part of the gripper finger and connected to the gripper point, the resilient section having neutral fibers and being formed of two mutually resilient rods spaced from and connected in parallel with one another, the resilient rods extending in planes parallel to a plane passing through the longitudinal axis of the gripper shaft and through the gripper point, the gripper finger being formed of a head portion carrying the gripper point, a foot portion and a resilient section connecting the head portion to the foot portion and formed of the parallel resilient rods, and being connected by the foot portion directly with the gripper shaft so as to be secured against torsion.

In accordance with an added feature of the invention, the gripper shaft is formed with a recess through which the gripper fingers extend dramatically, the recess having an opening facing away from the gripper point, the recess and the resilient rod having a cross section matching one another over a short length in vicinity of the opening.

The orientation of the gripper finger with respect to the gripper shaft is thereby facilitated.

In accordance with an additional feature of the invention, a clamping device connecting the gripper finger firmly with the gripper shaft has a cylindrical clamping sleeve formed with a central slot and clamped between two clamping jaws braced with the gripper shaft, the resilient rod being clamped in the slot formed in the clamping sleeve.

The gripper finger is thereby turnable about the longitudinal axis thereof and can accordingly be oriented especially simply to effect a flat contact with an appertaining gripper cushion, whereby the clamping device has to be only slightly loosened.

In accordance with yet another feature of the invention, the resilient rod, at the end thereof facing away from the gripper point, has a cylindrical extension formed integrally with the resilient rod and having a longitudinal axis aligned with the longitudinal axis of the diametric recess, the cylindrical extension being clamped between the clamping jaws braced with the gripper shaft.

This provides a further facilitation of the assembly of the gripper device.

In accordance with yet a further feature of the invention, a second section of the resilient rod matching the outer contour of the gripper shaft is connected to the resilient section of the gripper finger, the second section being in engagement with the gripper shaft and being clamped between the gripper shaft and a clamping member having the adjusting means.

Such a gripper device can be used in an advantageous manner where there are adequate spatial conditions.

In accordance with yet an added feature of the invention, the gripper device includes a compression spring having a force-applying direction substantially perpendicular to the neutral fibers, the compression spring being connected in parallel with the gripper finger formed as a resilient rod, the compression spring being braced against the clamping device having the adjusting means for connecting the gripper finger to the gripper shaft.

In this regard, especially desirable conditions or requirements with respect to the bending stress in the installation location of the gripper finger must be considered.

In accordance with yet an additional feature of the invention, the gripper finger, in which the neutral fibers of the resilient section extend in planes parallel to the plane determined by or passing through the longitudinal axis of the gripper shaft and through the gripper point, are formed of a head portion carrying the gripper point, a foot portion and a resilient section connecting the head portion to the foot portion, the resilient section being in the form of two parallel resilient rods and being connected secured from torsion with the foot portion directly to the gripper shaft.

Further facilitations with respect to the assembly of the gripper device are thereby achieved.

In accordance with still another feature of the invention, the resilient rods are arranged symmetrically to the gripper shaft.

This construction combines the advantage of a simplified assembly with the applicability of a gripper device according to the invention in cramped spatial conditions, because the resilient rods can, if necessary or desirable, be lengthened thereby until they extend beyond the middle of the gripper shaft.

In accordance with still a further feature of the invention, one of the parts of the gripper finger mutually connected by the resilient rods has a counterbearing of the adjusting means, and the other of the parts has an adjusting member of the adjusting means braced against the counterbearing.

In accordance with still an added feature of the invention, the head portion, the foot portion, the counterbearing and the resilient rods form an integral gripper finger.

The gripper finger can thereby be produced exceptionally economically from extrusion press profiled material.

In accordance with still an additional feature of the invention the head portion of the gripper finger is non-resilient, and both of the resilient rods are formed of legs of a U-shaped angularly bent leaf spring, the leaf spring having a part mutually connecting the legs thereof and clamped to the non-resilient head portion of the gripper finger, the legs having ends which are clamped between the gripper shaft and a clamping shell matching the cross section of the gripper shaft.

Such a gripper device is especially well suited for small series or multiple production.

In accordance with another feature of the invention, a common clamping shell is provided for both the ends of the legs.

In this way, a reduction in the required component parts is capable of achievement also for a gripper device suited especially for small series or multiple production.

In accordance with a further feature of the invention, the gripper device includes an adjusting block arranged on the the side of the gripper shaft located opposite the clamping shell and between the legs of the U-shaped leaf spring, the adjusting block matching the contour of the gripper shaft and being clamped together with the clamping shell against the gripper shaft, the adjusting block carrying setting means engageable with one of the legs of the leaf spring.

This permits relatively good accessibility of the fastening means for the adjusting block while simultaneously economizing on fastening means for a gripper device assembled of several individual parts.

In accordance with an added feature of the invention, adjusting means is constructed so as to twist the gripper finger.

In accordance with an additional feature of the invention, the adjusting means having setscrews spaced in longitudinal direction of the gripper shaft, the setscrews being adjustable for twisting the gripper finger.

Gripper devices constructed in accordance with both of the foregoing constructions permit the gripper finger to be oriented so that its gripper point is disposed flat on the appertaining gripper support, without having to loosen the clamping means.

In accordance with another feature of the invention, the gripper finger has a compound construction.

It is possible thereby to match the choice of materials optimally to the respective demands which are made on the different sections of a gripper finger according to the invention, such as, for example, a good adhesion effect of the gripping surface of the gripper point and good spring characteristics of the resilient section of the gripper finger.

In accordance with a concomitant feature of the invention, components of the resilient section are formed of fiber-reinforced plastic material.

The mass moment of inertia of a gripper finger constructed in accordance with the invention can thereby be further reduced in size or miniaturized.

Other features which are considered as characteristic for the invention are set forth in the appended claims.

Although the invention is illustrated and described herein as embodied in a gripper device for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
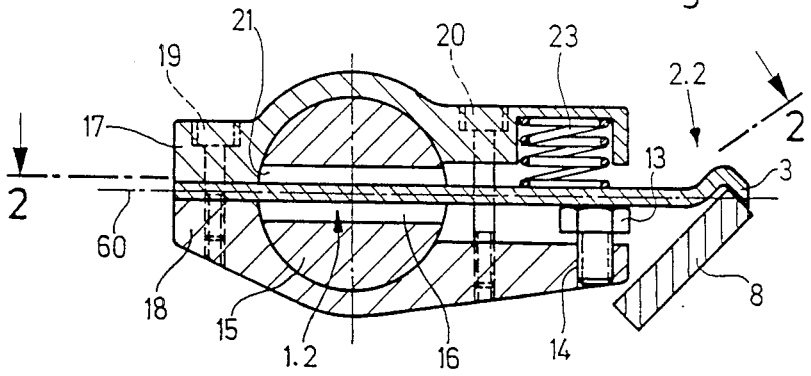
FIG. 1 is a cross-sectional view of a gripper shaft having a gripper finger in the form of a resilient rod assembled thereon in a first embodiment of the invention wherein the gripper finger extends through the gripper shaft.
Figure 2:
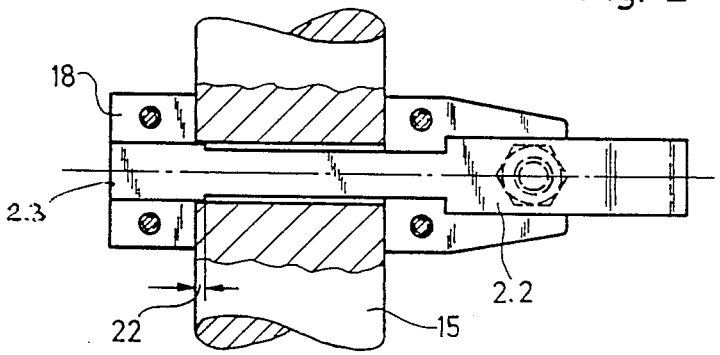
FIG. 2 is a fragmentary longitudinal sectional view of FIG. 1 taken along the line 2—2.

Referring now to the drawing and first, particularly to FIGS. 1 and 2, there is shown therein a first embodiment of the invention which is especially suited for use in narrow or cramped space relationships. In this regard, a gripper shaft 15 is provided with a diametric recess 16 which has a cross-section larger than that of a gripper finger 2.2 extending through the recess 16.

The gripper finger 16 is formed as a resilient rod having a gripper point 3 at one end thereof and clamped between two clamping jaws 17 and 18 at the other end thereof located beyond or outside an opening 21 of the recess 16 facing away from the gripper point 3, the clamping jaws 17 and 18 being, in turn, clamped by clamping screws 19 and 20 to the gripper shaft 15.

The clamping jaws 17 and 18 thus provide a rigid connection of the gripper finger 2.2 to the gripper shaft 15.

The lower clamping jaw 18, as viewed in FIG. 1, is provided with adjusting means in the form of a setscrew 13 engaging in a threaded bore 14 formed in the lower clamping jaw 18, the set-screw 13 being set against the underside of the gripper finger 2.2, as viewed in FIG. 1.

A compression spring 23 connected in parallel with the resilient rod is arranged between the upper side of the gripper finger 2.2 and the upper clamping jaw 17, as viewed in FIG. 1. The direction in which the force of the compression spring 23 acts is perpendicular to the neutral fibers of a resilient or springy section 1.2 of the gripper finger 2.2.

In FIG. 1, that operating condition is represented when the gripper point 3 comes into contact with a gripper cushion 8. The neutral fibers of the resilient rod are disposed in a plane 60 determined by an axis extending through the gripper shaft 15 and the gripper point 3. In this position, the gripper finger 2.2 is already subject to the clamping force of the compression spring 23 as well as to its own clamping force. These clamping forces are absorbed by the setscrew 14. To attain an adequate force by which the gripper point 3 holds the gripper cushion 8, only an exceedingly slight deflection of the gripper point 3 with respect to the clamped other end of the resilient rod is necessary because, immediately after the resilient rod is lifted away from the setscrew 14, as a result of the additional swing of the gripper shaft 15 in closing direction, the clamping forces become effective on the gripper cushion 8.

To facilitate a rapid correctly or justifiedly positioned assembly of the gripper device on the gripper shaft 15, the cross-sections of the recess 16 and of the gripper finger 2.2 are mutually matched along a short length 22 (FIG. 2) in vicinity of the opening 21 of the diametric recess 16 facing away from the gripper point 3.

Figure 3:
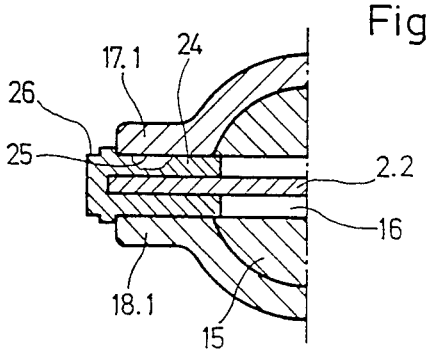
FIG. 3 is a fragmentary cross-sectional view of a second embodiment of the invention wherein a gripper finger is rotatable in a clamped location thereof.

In the construction of FIG. 3, the resilient rod 2.2 is received, with the end thereof facing away from the gripper point 3, in a centered slot formed in a clamping sleeve 24 clamped between an upper and a lower clamping jaw 17.1 and 18.1, respectively. In this regard, both clamping jaws 17.1 and 18.1 are shaped so that they, with their left-hand ends, as viewed in FIG. 3, form a cylindrical receiver 25 for the clamping sleeve 24 which is likewise cylindrical. Accordingly, by turning the clamping sleeve 24 and then clamping the two clamping jaws 17.1 and 18.1, the resilient rod 2.2 is adjusted so that the gripper point 3 lies uniformly on the gripper cushion 8. To turn the sleeve 24, it is formed with gripper surfaces or flats 26 for engagement by a suitable tool. In accordance with an embodiment not specifically shown in the drawing, the resilient rod 2.2 and the clamping sleeve 24 (FIG. 3) is also of integral or one-piece construction. In this regard, the resilient rod 2.2 is provided with a cylindrical extension 2.3 at the end thereof facing away from the gripper point 3, the cylindrical extension being rotatably fitted in the receiver 25.

A rapid justifiedly positioned assembly is achieved when the diameter of the diametric recess 16 and the cylindrical extension 23 are mutually matched, the receiver 25 formed by the clamping jaws 17.1 and 18.1 for the cylindrical extension is in alignment with the diametric recess 16, and the cylindrical extension engages in the diametric recess 16 only along a short length 22 thereof. To turn the cylindrical extension 2.3 and, accordingly, also the gripper point 3 to a position wherein the latter engages the gripper cushion 8, the cylindrical extension 2.3 is, in turn, provided advantageously with gripper surfaces or flats for engagement by a suitable tool.

Figure 4:
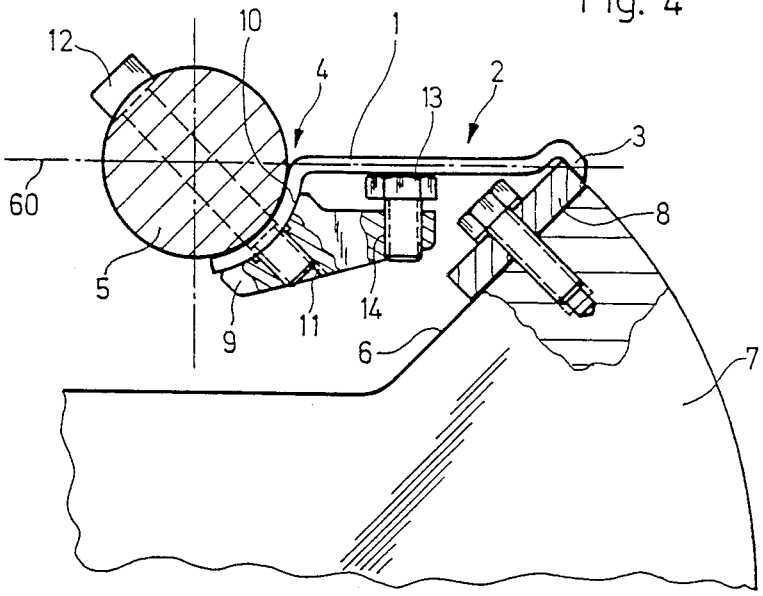
FIG. 4 is a cross-sectional view of a third embodiment of the invention having a gripper finger in the form of a resilient rod disposed on the gripper shaft.
Figure 5:
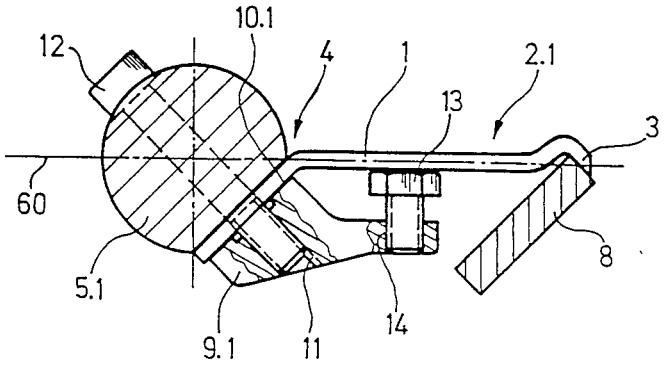
FIG. 5 is a cross-sectional view of a fourth embodiment of the invention having a gripper finger engaging the gripper shaft in a manner somewhat modified from that of the embodiment of FIG. 4.

FIGS. 4 and 5 disclose different embodiments of gripper devices according to the invention which can be used advantageously when there are adequate spatial conditions or relationships in a sheet transfer device and an impression cylinder respectively, of a printing machine. In the case of an adequate availability of space, the resilient or springy section 1 of the gripper finger 2, 3.1 can be formed with such length that greater deflection of the gripper point 3 thereof will not produce any impermissibly high bending stresses in a clamped location 4, when cardboard or heavy pasteboard, for example is being processed. Neutral fibers of the resilient section 1 of the gripper finger 2, 2.1 are disposed in a position prestressed by the adjusting means in the plane 60 which is determined by the longitudinal axis of the gripper shaft 5, 5.1 and the gripper point 3.

The gripper finger 2, 2.1, as in the embodiment of FIGS. 1 and 2, is formed as a resilient rod in the embodiments of FIGS. 4 and 5 and carries a gripper point 3, as well, on its free end. The gripper devices of FIGS. 4 and 5 are, in turn, represented at an operative condition or phase wherein the gripper point 3 has, in fact, come into contact with a gripper seat or support which, in the embodiment of FIGS. 4 and 5, is a gripper cushion 8 fastened to a wall 6 of a channel of a cylinder 7.

To actuate the gripper device of either FIG. 4 or FIG. 5, the gripper shaft 5 is turned in a conventional manner through a predetermined swivel angle relatively to the cylinder 7 in one or the other rotary direction. By means of a suitable turn of the gripper shafts in clockwise direction through a first portion of the swivel angle, the gripper point 3 is shifted from a non-illustrated position thereof corresponding to an opened gripper device to the position thereof shown in FIGS. 4 and 5. Upon turning the gripper shaft 5 through the remaining portion of the swivel angle, the gripper point 3 is pressed, with an application of a holding force, against the gripper cushion 8, whereby a printed sheet is clamped between the gripper point 3 and the gripper cushion 8.

Simultaneously, due to the spring action of the resilient section 1, the gripper point 3 is deflected a slight amount relatively to the clamped location 4 in a substantially circular arc about this clamped location 4.

To produce an adequate holding or retaining force, only an additional very slight deflection of the gripper point 3 is necessary, because the gripper finger 2, 2.1 has already been prestressed by the adjusting means. There is virtually no shifting of the gripper point 3 on the gripper support 8 resulting from this deflection.

The gripper finger 2, 2.1 constructed as a resilient rod (FIGS. 4 and 5) is formed with a non-resilient section connected to the resilient section 1, the non-resilient section being matched to the outer contour of the gripper shaft 5, 5.1, being in engagement therewith and being clamped between it and a clamping member 9, 9.1. In this regard, the clamping member 9, 9.1 is provided with a respective contact surface 10, 10.1 matching the shape of the respective non-resilient section of the gripper finger 2, 2.1 and with a bore formed with an internal thread 11 wherein a clamping bolt 12 passing diametrically through the gripper shaft 5, 5.1 is threadedly engaged.

The clamping device formed with the clamping member 9, 9.1 is provided with the adjusting means for effecting contact between the gripper point 3 ad the gripper support 8 and, in fact, is in the form of the setscrew 13 which engages in a threaded bore 14 formed in the clamping member 9, 9.1 and engages with the underside of the resilient section 1.

The gripper finger 2, 2.1 is prestressed by the setscrew 13 so that if the setscrew 13 and the gripper cushion 8 were conceivably removed, the resilient section 1, in this unstressed position and in the rotary position of the gripper shaft 5 shown in FIGS. 4 and 5, would be arched downwardly.

The embodiments of the invention according to FIGS. 4 and 5 differ from one another by the shape of the non-resilient contact section 10, 10.1 engaging with the gripper shaft 5. In the embodiment of FIG. 4, the contour of the gripper shaft 5 is circular in the vicinity of the contact section 10, whereas the gripper shaft 5 in the embodiment of FIG. 5 is formed with a flat in this region, so that the surface of the contact section 10.1 of the clamping member 9.1 is also a planar surface.

Figure 6:
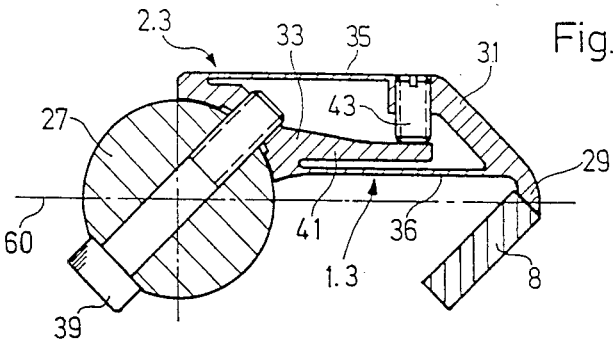
FIG. 6 is a cross-sectional view of a gripper shaft having, in a fifth embodiment of the invention, a gripper finger formed of parallel resilient rods assembled thereon.
Figure 7:
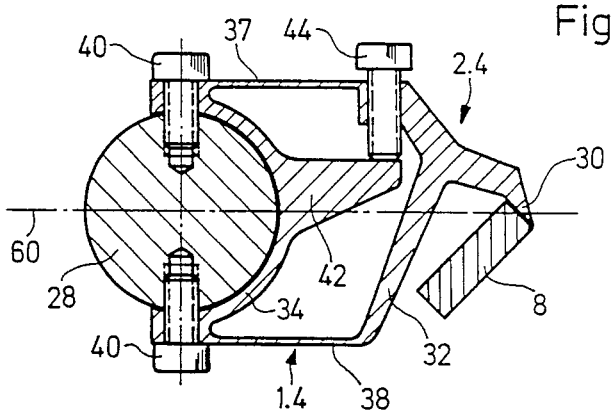
FIG. 7 is a cross-sectional view of a sixth embodiment of the invention having resilient rods arranged symmetrically with the gripper shaft.

FIGS. 6 and 7 show an embodiment of the invention wherein neutral fibers or axes of a resilient section 1.3, 1.4 of the gripper finger 2.3, 2.4 lie, in accordance with the invention, in the plane 60 determined by the longitudinal axis of the gripper shaft 27, 28 and the gripper point 29, 30.

The gripper finger 2.3, 2.4, in this regard, is formed of a head portion 31, 32, a foot portion 33, 34 being directly connected, fixed against mutual rotation, with the gripper shaft 27, 28. The lengths of the resilient rods 1.3, 1.4 are selective independently of one another.

The embodiment according to FIG. 6 can, in turn, be used advantageously when the space relationships or conditions are adequate, whereas the embodiment of FIG. 7 is especially suited for narrow or tight installation conditions. As aforementioned, this depends upon the interplay of permissible bending stress and deflection of the resilient rods.

To connect the foot portion 33, 34 so that it is secure against rotation, it is matched to the contour of the gripper shaft 27, 28 and threadedly secured by clamping screws or bolts 39, 40 to the gripper shaft 27, 28.

The embodiment according to FIG. 7 provides an alternative construction to that of FIGS. 1 and 2 wherein the cross section of the gripper shaft is not weakened by the diametric recess provided thereat and, nevertheless, a long resilient section of the gripper finger may be selected. In this regard, the resilient rods 37 and 38 are arranged symmetrically to the gripper shaft 28, and the foot portion 34 is threadedly secured by retaining screws 40 in threaded blind bores formed in the gripper shaft.

The adjustment means are formed in FIGS. 6 and 7 of a counterbearing 41, 42 projecting from the foot portion 33, 34 and of adjustment screws or setscrews 43, 44 braced against the counterbearing 41, 42 and engaging in an internal thread formed in the head portion 31, 32. The resilient section in the form of the parallel resilient rods 35, 36 and 37, 38, respectively, as described hereinabove, are retained under prestress in the position parallel to the plane 60 by means of these adjustment screws 43, 44.

As shown in FIGS. 6 and 7, the head portion, the foot portion, the counterbearing and the resilient rods can be constructed as an integral gripper finger, in an advantageous manner.

Figure 8:
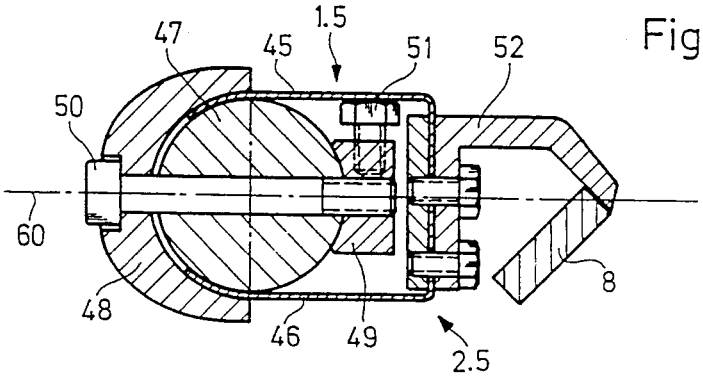
FIG. 8 is a cross-sectional view of a seventh embodiment of the invention which has an alternate construction to that of FIG. 7.
Figure 9:
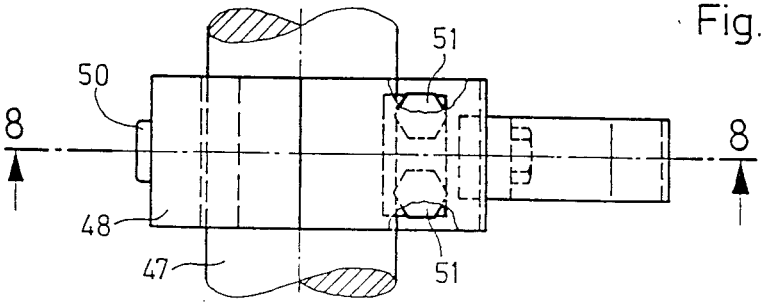
FIG. 9 is a plan view of the embodiment of FIG. 8.

FIG. 8 shows a structural modification in the embodiment of FIG. 7 which is especially suited for smaller quantity production. In this regard, both resilient rods 45, 46 are formed from the legs of a U-shaped angularly bent leaf spring. A part of the leaf spring which connects the two legs in threadedly secured to the head portion 52. Ends of the legs are clamped between the gripper shaft 47 and a clamping shell 48 matching the cross section or contour of the gripper shaft 47, and clamping both ends of the legs in common. For this purpose, the clamping shell 48 surrounds about half of the periphery of the gripper shaft 47. On the side of the gripper shaft located opposite from the clamping shell 48, an adjustment block 49 is arranged between the legs of the U-shaped angularly bent leaf spring. The adjustment block 49 matches the contour of the gripper shaft and is clamped in common with the clamping shell 48 against the gripper shaft by means of a retaining bolt 50 extending through a bore formed in the gripper shaft. Setscrews engaging in internal threads formed in the adjustment block are set into engagement with the upper leg of the leaf spring, as viewed in FIG. 8. The adjustment block 49 and the setscrews 51 form the adjusting means with which, in turn, the resilient section 1.5 of the gripper finger 2.5 is held under prestressing in position parallel to the plane 60. The setscrews are thus mutually spaced in longitudinal direction of the gripper shaft. The gripper finger can thereby, if necessary or desirable, be so twisted or bent that the gripper point will lie flat on the gripper cushion.

The setscrews, in fact lose their effectiveness the instant the gripper shaft, after the gripper point comes into contact with the gripper cushion, is swivelled farther in the closing or locking direction. The full contact or engagement of the gripper point with the gripper cushion is nevertheless maintained if the gripper finger is constructed with a twist.

Another modification of the embodiments of FIGS. 6 and 7 which is not illustrated in the drawing results from configuring the gripper finger as a so-called compound structure. In this regard, the head portion 31, 32 and the foot portion 33, 34 are made of an aluminum alloy and the resilient rods of spring steel, and are cast or molded into the head and foot portion.

The foregoing is a description corresponding in substance to German Application P 36 44 484.7, dated Dec. 24, 1986, the International priority of which is being claimed for the instant application, and which is hereby made part of this application. Any material discrepancies between the foregoing specification and the aforementioned corresponding German application are to be resolved in favor of the latter.

We claim:

1. Gripper device for a printing machine for handling sheet-shaped material with a gripper support a gripper shaft swivellable about its longitudinal axis and a gripper finger firmly connected to the gripper shaft so that the gripper point thereof is movable away from a gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support, comprising a resilient section forming a part of the gripper finger and connected to the gripper point, said resilient section having neutral fibers and formed as at least one resilient rod extending substantially in the direction of a plane determined by the longitudinal axis of the gripper shaft and by the gripper point.

2. Gripper device according to claim 1, wherein said resilient section is formed as a single resilient rod extending substantially in said plane determined by the longitudinal axis of the gripper shaft and by the gripper point.

3. Gripper device according to claim 1, wherein said resilient section is formed of two mutually resilient rods spaced from one another, connected in parallel with one another and extending in planes parallel to said first-mentioned plane.

4. Gripper device according to claim 1 including a clamping member having the contact adjusting means, and wherein a second section of said resilient rod matching the outer contour of the gripper shaft is connected to said resilient section of said gripper finger, said second section being in engagement with the gripper shaft and being clamped between the gripper shaft and the clamping member having the adjusting means.

5. Gripper device according to claim 1 including a clamping member having the contact adjusting means, and a compression spring having a force-applying direction substantially perpendicular to the neutral fibers, said compression spring having a spring force acting in parallel with a corresponding force of the gripper finger formed as a resilient rod, said compression spring being braced against the clamping member having the adjusting means for connecting the gripper finger to the gripper shaft.

6. Gripper device according to claim 1, wherein the adjusting means is constructed so as to twist the gripper finger.

7. Gripper device according to claim 1, the adjusting means having setscrews spaced in longitudinal direction of the gripper shaft, said setscrews being adjustable for twisting the gripper finger.

8. Gripper device according to claim 1, wherein components of said resilient section are formed of fiber-reinforced plastic material.

9. Gripper device for a printing machine for handling sheet-shaped material with a gripper support, a gripper shaft swivellable about its longitudinal axis and a gripper finger firmly connected to the gripper shaft, said gripper finger being formed with a gripper point which is movable away from the gripper support when the gripper shaft is swivelled in a first direction, is initially displaceable into contact with the gripper support when the gripper shaft is swivelled in a second direction opposite to the first direction, and is capble of exerting a holding force on the gripper support when the gripper shaft is swivelled farther in the second direction, and means for adjusting contact between the gripper point and the gripper support, comprising a resilient section forming a part of the gripper finger and connected to the gripper point, said resilient section having neutral fibers and being formed as a single resilient rod extending substantially in a plane determined by the longitudinal axis of the gripper shaft and by the gripper point, said resilient section extending freely through the gripper shaft and being firmly clamped, at the end thereof facing away from the gripper point, to the gripper shaft.

10. Gripper device according to claim 9 wherein the gripper shaft is formed with a recess through which the gripper finger extends diametrically, said recess having an opening facing away from the gripper point, said recess and said resilient rod having a cross section matching one another over a short length in vicinity of said opening.

11. Gripper device according to claim 10 wherein a clamping device connecting the gripper finger firmly with the gripper shaft has a cylindrical clamping sleeve formed with a central slot and clamped between two clamping jaws braced with the gripper shaft, the resilient rod being clamped in said slot formed in said clamping sleeve.

12. Gripper device according to claim 11 wherein said resilient rod, at the end thereof facing away from the gripper point, has a cylindrical extension formed integrally with the resilient rod and having a longitudinal axis aligned with the longitudinal axis of the diametric recess, said cylindrical extension being clamped between the clamping jaws braced with the gripper shaft.

13. Gripper device for a printing machine for handling sheet-shaped material with a gripper support, with a gripper shaft swivellable about its longitudinal axis and a gripper finger firmly connected to the gripper shaft, said gripper shaft being formed with a gripper point which is movable away from the gripper support when the gripper shaft is swivelled in a first direction, is initially displaceable into contact with the gripper support when the gripper shaft is swivelled in a second direction opposite to the first direction, and is capable of exerting a holding force on the gripper support when the gripper shaft is swivelled farther in the second direction, and means for adjusting contact between the gripper point and the gripper support, comprising a resilient section forming a part of the gripper finger and connected to the gripper point, said resilient section having neutral fibers and being formed of two mutually resilient rods spaced from and connected in parallel with one another, said resilient rods extending in planes parallel to a plane passing through the longitudinal axis of the gripper shaft and through the gripper point, the gripper finger being formed of a head portion carrying the gripper point, a foot portion and a resilient section connecting the head portion to the foot portion and formed of said parallel resilient rods, and being connected by the foot portion directly with the gripper shaft so as to be secured against torsion.

14. Gripper device according to claim 13, wherein said resilient rods are arranged symmetrically to the gripper shaft.

15. Gripper device according to claim 13, wherein one of the parts of the gripper finger mutually connected by said resilient rods has a counterbearing of the adjusting means, and the other of the parts has an adjusting member of the adjusting means braced against said counterbearing.

16. Gripper device according to claim 15, wherein said head portion, said foot portion, said counterbearing and said resilient rods form an integral gripper finger.

17. Gripper device according to claim 14, including a clamping shell matching the cross section of the gripper shaft, and wherein the head portion of the gripper finger is non-resilient, and both of said resilient rods are formed of legs of a U-shaped angularly bent leaf spring, said leaf spring having a part mutually connected said legs thereof and clamped to said non-resilient head portion of the gripper finger, said legs having ends which are clamped between the gripper shaft and the clamping shell.

18. Gripper device according to claim 17, wherein a common clamping shell is provided for both the ends of said legs.

19. Gripper device according to claim 17, including an adjusting block arranged on the the side of the gripper shaft located opposite said clamping shell and between said legs of said U-shaped leaf spring, said adjusting block matching the contour of the gripper shaft and being clamped together with said clamping shell against the gripper shaft, said adjusting block carrying setting means engageable with one of the legs of said leaf spring.

20. Gripper device according to claim 13, wherein the gripper finger has a compound construction.

* * * * *